United States Patent [19]

Suzuki et al.

[11] Patent Number: 4,525,693

[45] Date of Patent: Jun. 25, 1985

[54] TRANSMISSION LINE OF UNSINTERED PTFE HAVING SINTERED HIGH DENSITY PORTIONS

[75] Inventors: Hirosuke Suzuki, Kotesashi; Hajime Ohki, Komae, both of Japan

[73] Assignee: Junkosha Company Ltd., Tokyo, Japan

[21] Appl. No.: 483,684

[22] Filed: Apr. 11, 1983

[30] Foreign Application Priority Data

May 1, 1982 [JP] Japan ..... 57-73821

[51] Int. Cl.[3] ..... H01P 3/16

[52] U.S. Cl. ..... 333/236; 333/240; 333/242; 156/47; 156/184

[58] Field of Search ..... 333/236, 239, 240, 242; 350/96.30; 156/48, 53, 47, 184; 29/600; 174/110 FC

[56] References Cited

U.S. PATENT DOCUMENTS

| | | | |
|---|---|---|---|
| 2,595,078 | 4/1952 | Iams | 333/239 |
| 2,606,134 | 8/1952 | Sanders | 174/110 FC X |
| 2,685,068 | 7/1954 | Goubau | 333/240 |
| 2,849,692 | 8/1958 | Fox | 333/240 |
| 2,946,710 | 7/1960 | Fields | 156/53 |
| 3,054,710 | 9/1962 | Nixon | 156/53 X |
| 3,278,673 | 10/1966 | Gore | 174/110 FC X |
| 3,408,453 | 10/1968 | Shelton, Jr. | 174/110 FC X |
| 3,588,754 | 6/1971 | Hafner | 333/240 X |
| 4,106,847 | 8/1978 | Arnaud | 350/96.3 X |
| 4,293,833 | 10/1981 | Popa | 333/239 |
| 4,307,938 | 12/1981 | Dyott | 350/96.3 |
| 4,415,230 | 11/1983 | Keck | 350/96.3 X |

OTHER PUBLICATIONS

Chandler, *An Investigation of Dielectric Rod as Wave Guide*, Journal of Applied Physics, vol. 20, Dec. 1949, pp. 1188–1196.

Okamoto, Katsunari et al., "Linearly Single Polarization Fibers with Zero Polarization Mode Dispersion", IEEE Jorn'l Quantum Elec., vol. QE-18, #4, Apr. '82.

*Primary Examiner*—Eugene R. LaRoche
*Assistant Examiner*—Benny T. Lee
*Attorney, Agent, or Firm*—Mortenson & Uebler

[57] ABSTRACT

A transmission line is provided, at least a portion of the wave energy transmitting part of the line being made of a dielectric material shaped to create a physical condition which preserves the deflected wave surface of the electromagnetic wave along the portion of the transmission line. The physical condition for preserving the deflected wave surface is formed by providing at least one linear portion which retards the speed of energy transmission so as to prevent the rotation of the electric field surface of the electromagnetic wave. The wave energy transmitting portion composed of dielectric material is preferably made to have an oval cross-section in which the ratio between the major axis and the minor axis has a value not lower than 4/3. Alternatively, the wave energy transmitting portion can be made to have a rectangular cross-section. The objects of the invention can also be attained by increasing the density of a portion of the line along its length or by applying a local stress over the entire length of the line.

2 Claims, 8 Drawing Figures

TRANSMISSION LINE OF UNSINTERED PTFE HAVING SINTERED HIGH DENSITY PORTIONS

BACKGROUND OF THE INVENTION

The present invention relates to a transmission line at least a part of which is composed of a dielectric material such as a dielectric line, surface wave line (including image line, insular line), a metallic wave guide tube lined with a dielectric material, and combinations thereof.

Waves in the frequency regions of millimeter waves, sub-millimeter waves and light waves are transmitted in one of the dielectric internal modes, either surface wave mode, wave guide tube mode or suitable combinations thereof. A transmision line making use of a dielectric material has high flexibility so that it can suitably be used in the flexed part of a metallic wave guide tube or in the connection between a metallic wave guide tube and associated equipment. A transmission line employing a dielectric material is attracting attention even in the form of a single line because it can be laid with a large degree of freedom at small radius of curvatures. In a transmission line having dielectric body, a problem is encountered because the direction of the electric field (or direction of the magnetic field) can be rotated undesirably. Namely, when a connection between transmission lines or between transmission line and equipment is made using this type of transmission line, even if the lines are independently adjusted to provide a connection to attain maximum output energy level for a given input level, the level of output is inevitably changed as the lines are moved or as time lapses.

Used those circumstances, the present invention provides a transmission line in which at least a portion thereof is composed of a dielectric body which overcomes the above-described problem of prior art transmission lines.

SUMMARY OF THE INVENTION

A transmission line is provided having at least a portion made of a dielectric material adapted to transmit the wave energy of an electromagnetic wave, wherein the dielectric material is formed in a physical state which preserves the deflected wave surface of the electromagnetic wave along the length of the transmission line. The physical state for preserving the deflected wave surface is provided by at least one linear portion thereof which retards the transmission speed of the wave energy in such a manner as to prevent the rotation of the electric field surface of the electromagnetic wave. Preferably, the wave energy transmitting portion of the transmission line is oval in cross-section, the ratio of the major axis to the minor axis being not less than 4/3. Also included are a transmission line wherein at least a part of the cross-section of the wave energy transmitting portion has increased density over the remainder of material in the cross-section, over the entire length of the line, and a transmission line wherein the wave energy transmitting portion is locally stressed over the entire length of the line. The preferred dielectric material is polytetrafluoroethylene.

DETAILED DESCRIPTION OF THE INVENTION AND PREFERRED EMBODIMENTS WITH REFERENCE TO THE DRAWINGS

A transmission line is provided, at least a portion of the wave energy transmitting part of the line being made of a dielectric material shaped to create a physical condition which preserves the deflected wave surface of the electromagnetic wave along the portion of the transmission line. The physical condition for preserving the deflected wave surface is formed by providing at least one linear portion which retards the speed of energy transmission so as to prevent the rotation of the electric field surface of the electromagnetic wave. The wave energy transmitting portion composed of dielectric material is preferably made to have an oval cross-section in which the ratio between the major axis and the minor axis has a value not lower than 4/3. Alternatively, the wave energy transmitting portion can be made to have a rectangular cross-section. The objects of the invention can also be attained by increasing the density of a portion of the line along its length or by applying a local stress over the entire length of the line.

The dielectric body in the electromagnetic wave energy transmitting portion of the transmission line can be made from one or more polymeric materials including, preferably, expanded unsintered polytetrafluoroethylene (PTFE), expanded partially sintered PTFE, expanded, sintered PTFE, unexpanded, unsintered PTFE, unexpanded, partially sintered PTFE, and unexpanded, sintered PTFE. With such materials, it is possible to obtain a transmission line having superior physical and chemical properties.

The dielectric material is produced, for example, by the method disclosed in Japanese Patent Publication No. 24241/1981 and Japanese Patent Publication No. 99955/1978.

The transmission line of the present invention having the described features offers the following advantages:

(1) The deflected wave surface of the electromagnetic wave is not changed even if the transmission line is curved at small radius of curvature. In addition, it is possible to obtain coincidence of the deflected wave surface in connections between transmission lines or connections to equipment. The readjustment of the transmisison line, therefore, is unnecessary.

(2) The undesirable time dispersion of a transmitted signal is prevented owing to the preservation of the deflected wave surface.

(3) The preservation of the deflected wave surface permits application to directional coupling or detection of electric field intensity making use of the Faraday effect.

The invention can best be described in detail with reference to the accompanying drawings.

Figure 1:
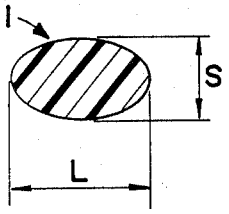

FIG. 1 shows a cross-section of a wave energy transmitting portion of a transmission line 1. The transmission line 1 is formed from, for example, unexpanded, unsintered PTFE using an oval die in a ram-type extruder. The transmission line 1 has a constant oval cross-section over the entire length thereof in which the ratio of the major axis L to the minor axis S is not smaller than 4/3. In this transmission line 1, the direction of electric field stands in the direction of minor axis of the oval shape. This effect is remarkable, particularly in the transmission of a single mode.

Figure 2:
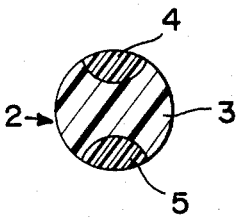

FIG. 2 shows a cross-section of a wave energy transmission line 2 in different embodiment of the invention. This transmision line 2 is formed by the following process. A cylindrical or columnar line 3 is formed by winding a tape of, for example, expanded, unsintered PTFE. Then the opposite portions 4 and 5 of the line 3 are sintered over the entire length of the transmission line to obtain opposing portions 4 and 5 having increased density. These portions 4 and 5 of high density are the portions which retard the speed of transmission of electromagnetic wave energy. The electric field surface of the electromagnetic wave energy stands in the direction perpendicular to the direction of the line interconnecting the opposing portions 4 and 5 of high density, so that the electric field surface is not rotated.

Figure 3:
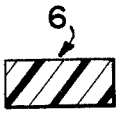

FIG. 3 shows a cross-section of the wave energy transmitting portion of a transmission line 6 in accordance with still another embodiment of the invention. This transmission line has a rectangular cross-section and if formed from, for example, of unsintered PTFE by extrusion using a rectangular die or, alternatively, by winding a tape of unsintered PTFE in a cylindrical form and then shaping the same under pressure to have a rectangular cross-section.

Figure 4:
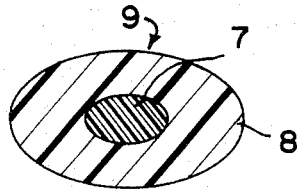
FIGS. 1 to 4 are cross-sectional views of transmission lines in accordance with different embodiments of this invention.

As shown in FIG. 4, a core member (wave energy transmitting portion) 7 of a cross-section similar to that in FIG. 1, having smaller and larger axes of 6 mm and 8 mm, was formed of extruded, unsintered PTFE having a specific gravity of 1.6. Then a tape of expanded, sintered PTFE having a specific gravity of 0.68 was wound around the core member 7 to constitute a cladding member 8. A transmission line 9 of 1 meter long and having an outside major axis of about 21 mm was obtained.

Figure 5:
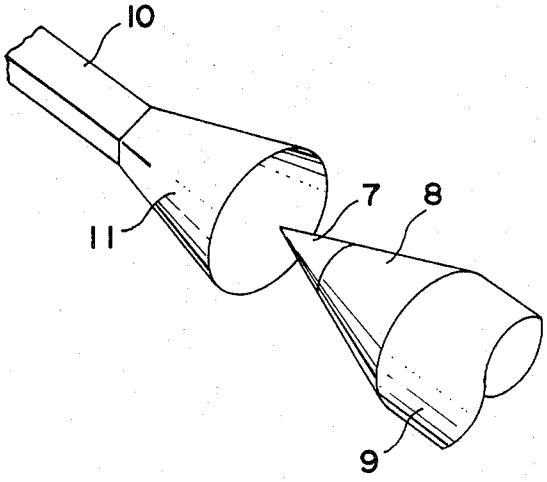
FIG. 5 is a perspective view illustrating the construction of a connection between a transmission line of the invention and a metallic wave guide tube.

Both ends of the transmission line 9 were shaped in conical form as shown in FIG. 5, and one conical end was fitted and coupled to a launcher 11 connected to a metallic wave guide tube 10 while the other end was fitted to another metallic wave guide tube 10, arranged linearly, in such a manner that the major axis of the transmission line 9 extends in the same direction as the longer side of the metallic wave guide tube. An electromagnetic wave of 50 GHz was inputted through one of the metallic wave guide tubes 10 and an output was obtained through the other wave guide tube 10. The amount of attenuation in this system was as small as 2 dB.

In this state, the transmission line was twisted until the direction of the longer side of the other metallic wave guide tube 10 coincided with the direction of the shorter side of the first metallic wave guide tube, i.e. the line was twisted by 90°, and the attenuation was measured. The increase in attenuation was as small as 1 dB.

A conventional transmission line consisting of a dielectric body was formed by preparing a core material the same as that memtioned above and having a circular cross-section of 7 mm diameter, and applying the same cladding member as above to provide an outside diameter of 21 mm. The increase of attenuation after a 90° twisting of this line was measured under the same conditions as above. In this case, the increase of the attenuation was as large as 10 dB. Thus, the present invention offers a remarkable improvement in that the increase of attenuation by a 90° twisting is reduced to 1/10.

Figure 6:
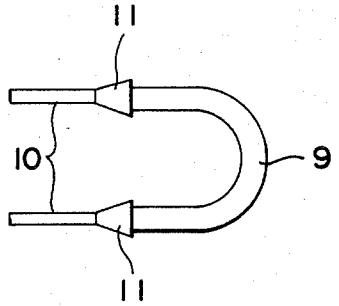
FIG. 6 is a plan view of the connecting construction between a transmission line and a metallic wave guide tube.

Then, the above array of the transmission line was laid in the shape of a "U" having a radius of curvature of 30 cm as shown in FIG. 6. An electromagnetic wave of 50 GHz was inputted through one of the metallic wave guide tubes 10 and the output was derived through the other metallic wave guide tube to measure the increase of the attenuation as compared to the linear arrangement. It was confirmed that the increase of the attenuation was as small as 0.5 dB which was about ¼ of that observed in the conventional transmission line having a circular cross-section. It will be seen that the transmission line 9 of the invention can achieve a remarkable reduction in the increae of the attenuation in all possible cases.

Figure 7:
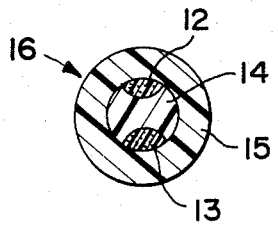
FIG. 7 is a cross-sectional view of a transmission line in accordance with another embodiment.

A transmission line 16 shown in cross-section in FIG. 7 prepared by the following process. First, a tape of unsintered PTFE having a specific gravity of 1.6 was wound into a cylindrical form having a circular cross-section and a diameter of 7 mm. Then, core member 14 was obtained having opposing portions 12 and 13 of increased densities (specific gravity 1.9) by sintering the cylindrically wound tape over the entire length thereof to a depth of about 2.5 mm. Then, a tape of expanded, sintered PTFE having a specific weight of 0.68 was wound around the core member 14 to form a cladding portion 15 having an outside diameter of 21 mm, thus completing the transmission line 16. This transmission line was then subjected to the measurement of attenuation in the same manner as above, and advantages substantially equivalent to those obtained before were confirmed.

Figure 8:
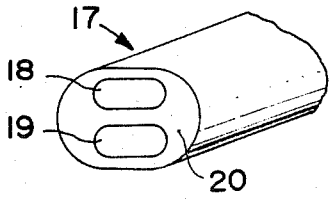
FIG. 8 is a perspective view of an end portion of a transmission line in accordance with still another embodiment.

FIG. 8 is an end perspective view of a transmission line 17 having multiple lines in accordance with the invention.

In this case, the portion for retarding the transmission speed of the electromagnetic wave energy to prevent the rotation of the electric field surface of the wave is constituted by two lines of core members 18 and 19 made of, for example, sintered PTFE to attain high density. In addition, an outer peripheral cladding member 20, made of expanded PTFE of low density, is formed around the core members 18 and 19.

As has been described, according to the invention, such a physical condition is created to preserve the deflected wave surface along the length so as to prevent rotation of the electric field surface of the electromagnetic wave, so that the positions of the electric surface positions at the inlet and outlet ends of the transmission line are made clear to offer the advantages as stated hereinabove.

The embodiments described above for attaining the described advantages are not exclusive and various changes may be imparted thereto. For instance, the deflected wave preservation surface may be rotated in the longitudinal direction or stress by pressure may be applied over the entire length of the line. It is also possible to increase the clad thickness and/or thickness of the protective layer on the portion which is to be stressed locally. It is also possible to provide a portion filled with a filler over the entire length of the line. It is possible to dispose a metallic member on the peripheral portion or to provide another protective layer. It is possible to add, for the purpose of adjustment of the dielectric constant or de-coloring, to a dielectric body of the line having a cross-section different from those of the described embodiments. Thus, equivalent effects to those provided by the embodiments described hereinbefore can be attained by various changes and modifications which are made within the scope of technical ideas of the present invention.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. An electromagnetic wave energy transmission line comprising a tape of expanded, porous, initially unsintered polytetrafluoroethylene, said tape being wound to form a substantially cylindrical cross section elongate transmission line, at least portions, but not all of the initially unsintered polytetrafluoroethylene within the cross section of said transmission line, being sintered along the entire length of said transmission line to produce high density portions of sintered polytetrafluoroethylene along its length, which high density portions retard the speed of electromagnetic energy such as to prevent rotation of the electric field within the transmission line.

2. The transmission line of claim 1 having an external cladding comprising sintered polytetrafluoroethylene.

* * * * *